US007740451B2

(12) United States Patent
Greim et al.

(10) Patent No.: US 7,740,451 B2
(45) Date of Patent: Jun. 22, 2010

(54) TURBOMACHINE BLADE

(75) Inventors: Ralf Greim, Birmenstorf (CH); Said Havakechian, Baden (CH); Ivan William McBean, Nussbaumen (CH)

(73) Assignee: Alstom Technology Ltd, Baden (CH)

( * ) Notice: Subject to any disclaimer, the term of this patent is extended or adjusted under 35 U.S.C. 154(b) by 91 days.

(21) Appl. No.: 12/003,710

(22) Filed: Dec. 31, 2007

(65) Prior Publication Data

US 2008/0152501 A1 Jun. 26, 2008

Related U.S. Application Data

(63) Continuation of application No. PCT/EP2006/063774, filed on Jun. 30, 2006.

(30) Foreign Application Priority Data

Jul. 1, 2005 (CH) ..... 1117/05

(51) Int. Cl.
*F01D 5/14* (2006.01)

(52) U.S. Cl. ..... 416/223 R; 416/238; 416/242; 416/243

(58) Field of Classification Search ..... 416/223 R, 416/238, 242, 243
See application file for complete search history.

(56) References Cited

U.S. PATENT DOCUMENTS 4,585,395 A * 4/1986 Nourse et al. ..... 416/223 A
4,826,400 A * 5/1989 Gregory ..... 415/181
5,249,922 A * 10/1993 Sato et al. ..... 415/191
5,342,170 A * 8/1994 Elvekjaer et al. ..... 415/192
5,575,620 A 11/1996 Haller et al.
6,331,100 B1 * 12/2001 Liu et al. ..... 416/238

FOREIGN PATENT DOCUMENTS

| | | | |
|---|---|---|---|
| DE | 37 43 738 | A1 | 7/1988 |
| DE | 42 28 879 | A1 | 3/1994 |
| EP | 1 106 836 | A2 | 6/2001 |
| GB | 2 151 310 | A | 7/1985 |
| JP | 1-106903 | A | 4/1989 |

OTHER PUBLICATIONS

Form PCT/ISA/210 (International Search Report, with English language translation of category of cited documents) dated Oct. 18, 2006.
Form PCT/ISA/237 (Written Opinion of the International Searching Authority) dated Oct. 18, 2006.
Swiss Search Report (with English language translation of category of cited documents) dated Oct. 23, 2005.
Christoph Pioske et al., "Dreidimensionale Turbinenbeschaufelung", MZT Motortechnische Zeitschrift, Jun. 1997, vol. 58, No. 6, pp. 358-362, XP-000700766 (cited in International Search Report and Swiss Search Report).
Traupel, Thermische Trubomaschinen ("Thermal Turbomaschines"), vol. 1, 4th Edition, Springer-Verlag, 2001, p. 326 (cited on p. 4-5 of the specification).

* cited by examiner

*Primary Examiner*—Igor Kershteyn
(74) *Attorney, Agent, or Firm*—Buchanan Ingersoll & Rooney PC

(57) ABSTRACT

The blades of a turbomachine comprise airfoils, which are bent such that the lean angle (ϕ), defined as the angle which the stacking line of the airfoil includes with the radial direction, and measured in the direction of rotation (ω), is variable along the width of the flow channel and decreases from the hub towards the housing.

27 Claims, 8 Drawing Sheets

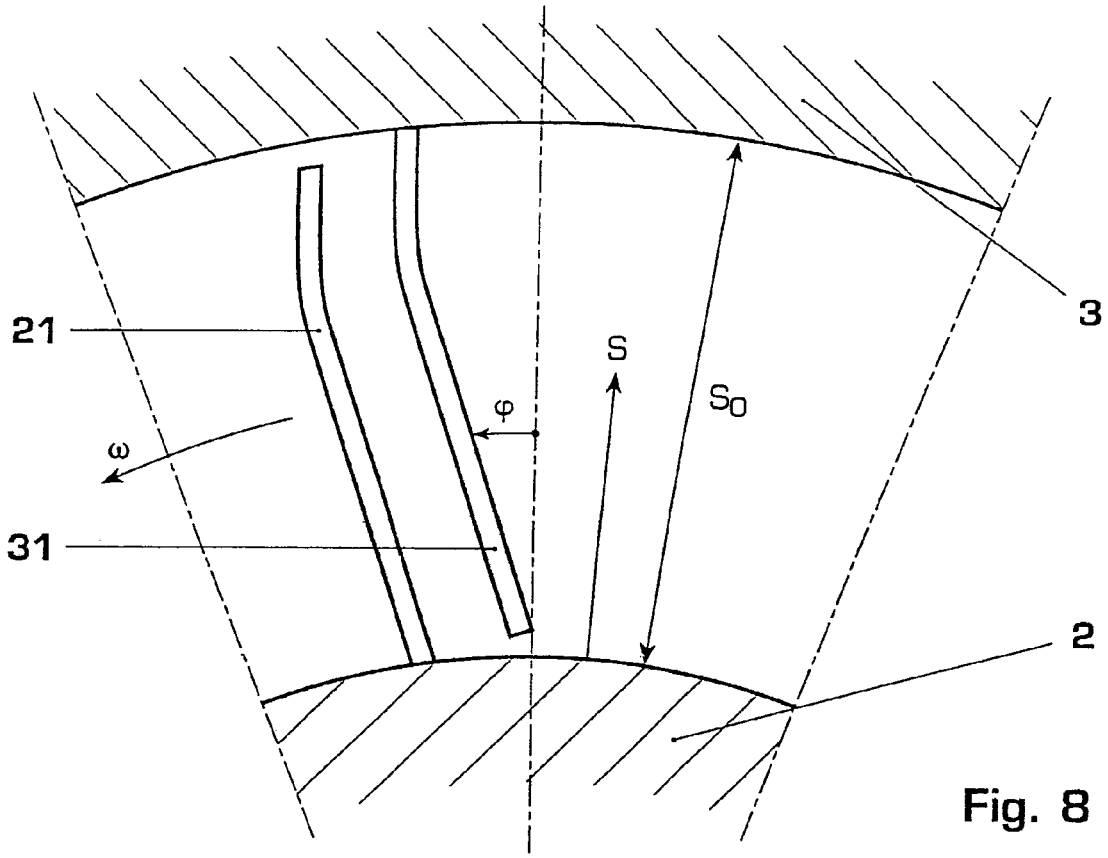
Fig. 8
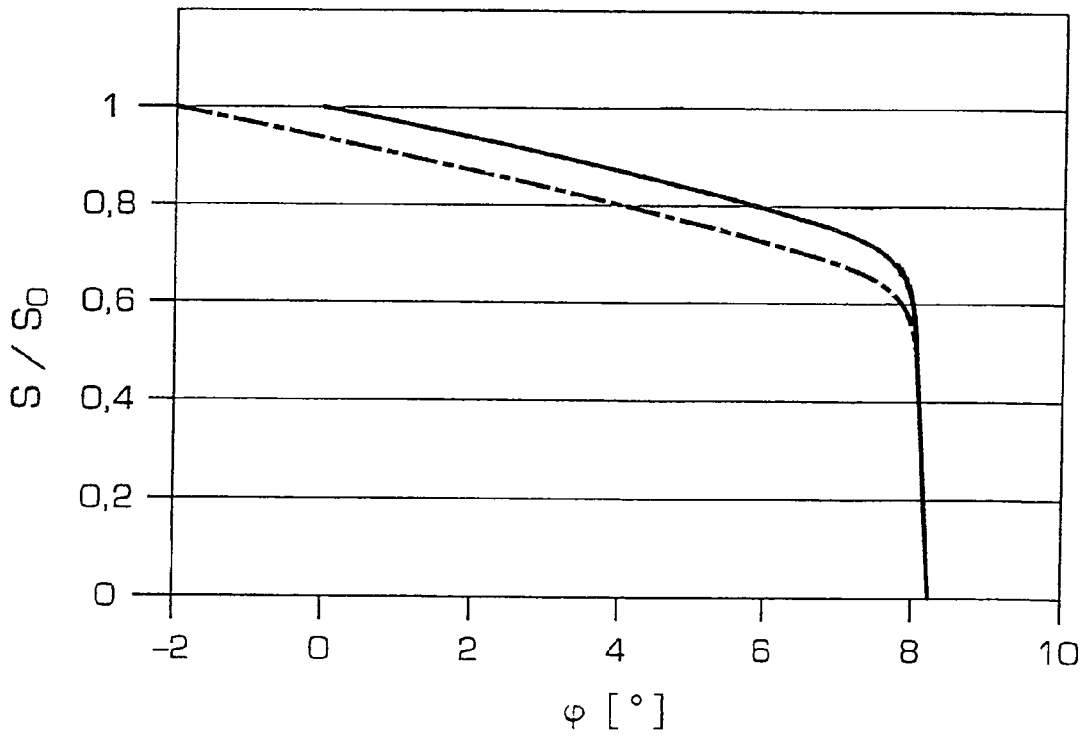

TURBOMACHINE BLADE

RELATED APPLICATIONS

This application claims priority under 35 U.S.C. §119 to Swiss Application No. 01117/05 filed in the Swiss Patent Office on 1 Jul. 2005, and as a continuation application under 35 U.S.C. §120 to PCT/EP2006/063774 filed as an International Application on 30 Jun. 2006 designating the U.S., the entire contents of which are hereby incorporated by reference in their entireties.

TECHNICAL FIELD

A turbomachine blade is disclosed. Furthermore, it also comprises a rotor and a stator of a turbomachine, especially of a steam turbine, and also a turbomachine itself, which comprises such blades.

BACKGROUND INFORMATION

With turbomachines, and especially turbines with untwisted blades, the degree of reaction of the stages across the spread of the blade locally deviates from the average design degree of reaction. The degree of reaction reduces towards the hub in relation to the center section, while it increases towards the casing. In this case, a decreasing degree of reaction signifies a relative increase of the pressure drop across the stator blade row of the stage, while an increased degree of reaction signifies a relative increase of the pressure drop across the rotor blade row. That is to say the pressure difference across a blade ring becomes large in each case at the blade tips at which the leakage losses are large anyway as a result of overflow, and sensitively react to pressure differences.

The increased leakages over the blade tips of the stator blades at the hub on the one hand, and over the blade tips of the rotor blades at the casing on the other hand, can be countered by the blade airfoils being tilted by an angle of inclination from the purely radial orientation. The overflow losses for example can be reduced by the blade airfoils of the stator blades being inclined by several degrees towards the hub by their pressure face. By the same token, the overflow losses are also reduced if the blade airfoils of the rotor blades are inclined by several degrees towards the hub by their suction face. By means of the inclination of the blade airfoils, additional radially oriented pressure fields are induced in the blade passages. Consequently, however, for example with stator blade passages in the region of the casing, it results in a secondary flow field being drawn further into the core flow, which leads to an increase of the secondary flow losses.

By means of inclining the blade airfoils, therefore, the overflow losses are reduced, but on the other hand the secondary flow losses increase so that their increase soon quickly overcompensates the reduction of the overflow losses. By means of an inclination of the blade airfoils, therefore, comparatively tight practical limits are set upon the reduction of the overflow losses.

SUMMARY

It is an object of the present disclosure, in addition to numerous others, to disclose a turbomachine blade of the type mentioned in the introduction, which avoids the disadvantages of the prior art. It is an object of the disclosure, for example, to disclose a turbomachine blade in such a way that in the region of the hub-side end the advantages of the inclination of the blade airfoil are made use of, and its disadvantages in the region which comes to lie on the outer blade ring diameter, do not have an effect.

A turbomachine blade is disclosed, comprising a blade airfoil, which extends with a longitudinal extent of the blade airfoil from a blade root to a blade tip, wherein the turbomachine blade has an installed radial direction, an installed circumferential direction and also an installed axial direction, and also a stacking line, and wherein an angle of inclination is defined as the angle which a projection of the stacking line has with the installed radial direction, in a plane which is spanned by the installed circumferential direction and the installed radial direction, wherein the angle of inclination ($\phi$) varies along the longitudinal extent of the blade airfoil.

BRIEF DESCRIPTION OF THE DRAWINGS

The disclosure is subsequently explained in more detail with reference to exemplary embodiments which are illustrated in the drawing. In detail, in the drawing:

FIG. 8 shows a part of a cross section of a turbomachine with blades of the type which is described above, and also an exemplary variation of the angle of inclination over the longitudinal extent of the blade airfoil.

Figure 1:
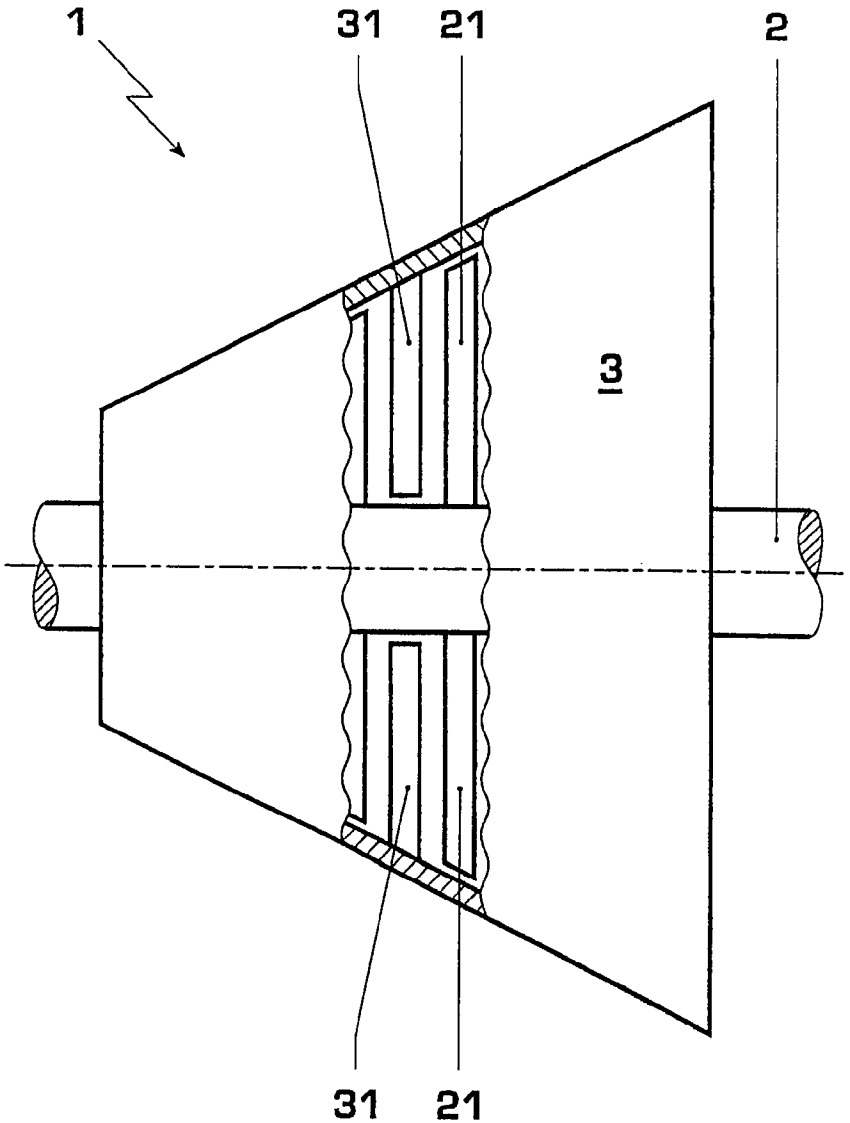
FIG. 1 shows a schematic view of a turbomachine.

Non-essential elements are omitted for the understanding of the disclosure. The exemplary embodiments are to be purely instructively understood, and are not to be considered as a limitation of the disclosure.

DETAILED DESCRIPTION

The turbomachine blade fulfils this requirement, in addition to a series of further advantages which the type of construction which is described there brings along with it. Thus, it concerns a turbomachine blade with a blade airfoil, wherein the blade airfoil extends with a longitudinal extent of the blade airfoil from a blade root to a blade tip. In this case, the blade root has a blade platform upon which the blade airfoil is seated. Furthermore, the blade airfoil has a so-called "stacking line". With an exemplary embodiment of a stator blade, this is defined on the trailing edge of the blade airfoil, and with an exemplary embodiment of a rotor blade is defined as a line which interconnects the centroids of all profile cross sections which are arranged in the longitudinal extent of the blade airfoil. The stacking line of a twisted blade airfoil can be understood as the line around which the blade airfoil is torsionally distorted or twisted, or as the line around which all blade airfoil profiles, which follow each other in the longitudinal extent of the blade airfoil, are twisted.

The trailing edge of the blade airfoil is defined in one exemplary embodiment as the number of points at which the camber line of the blade airfoil profile in each case penetrates the blade airfoil profile on the outflow side.

The angle of inclination of a blade airfoil, see for example *Traupel: "Thermische Turbomaschinen"* ["Thermal Turbomaschines"] Volume 1, $4^{th}$ edition, Springer-Verlag 2001, is defined as an angle by which a blade airfoil of a turbomachine blade in a turbomachine is inclined from the radial direction.

In this case, the inclination occurs in a cross-sectional plane of a turbomachine, and in the circumferential direction. With a twisted blade airfoil, the angle of inclination is measured on the stacking line, and, in fact, as the angle which a projection of the stacking line has with the installed radial direction, in a plane which is spanned by the installed circumferential direction and the installed radial direction. With the blade which is disclosed here, the stacking line is curved in such a way that the angle of inclination varies along the longitudinal extent of the blade airfoil. In this case, the variation of the angle of inclination $\phi$ along the longitudinal extent of the blade airfoil according to the disclosure occurs in two different regions, wherein the one region extends to a relative blade length of 0.7±0.1, and has an angle of inclination $\phi$ in the region of 7±3 degrees, and the second region which is adjacent to it extends to a relative blade length of 1, and at the end of this second region the angle of inclination $\phi$ is just 0±2 degrees. The variation of $\phi$ becomes smaller from the hub to the casing.

For definition of the installed directions for the blade as such, the following is to be noted: A turbomachine blade, for use in a turbomachine, has well-defined geometric parameters, which ensure the functional capability of the blade inside the turbomachine. From that point of view, the geometry of a turbomachine blade, and especially of the blade airfoil of the turbomachine blade, is specifically matched to the installed state. The installed position which is provided, therefore, must already be considered as a feature of the turbomachine blade itself, because the whole design of the turbomachine blade is oriented towards the installed position. Consequently, it is justifiable, in consideration of the turbomachine blade itself, to already speak of an installed radial direction in the direction of the radius of the turbomachine, an installed circumferential direction in the circumferential direction of the turbomachine, and an installed axial direction in the direction of the axis of the turbomachine, in the case of a turbomachine exposed to axial through-flow, according to the flow direction, and to use these as unambiguous and clear features of the blade itself. Upon this basis, the angle of inclination can also be determined for the blade as such. The angle of inclination in this case is defined in a plane which is spanned by the installed radial direction and the installed circumferential direction, according to *Traupel: "Thermische Turbomaschinen"* ["Thermal Turbomaschines"] Volume 1, $4^{th}$ edition, Springer-Verlag 2001, p. 326, para. 7.3.2.

In one exemplary embodiment of the turbomachine blade which is described here, the bend of the blade airfoil is two-dimensional and lies in the plane which is spanned by the installed radial direction and the installed circumferential direction.

In one exemplary embodiment of a turbomachine blade, the angle of inclination can also be defined as a complementary angle of the angle which the stacking line includes with the blade platform.

Exemplary embodiments can be realized by a blade with a twisted blade airfoil as well as by an untwisted blade airfoil.

A blade airfoil, which according to a strictly geometric definition is created as a result of the parallel displacement of a generatrix along a blade airfoil profile as a directrix, is to be understood by an untwisted blade airfoil. The generatrix in this case can be straight or also curved, and with each translation of the generatrix along the blade airfoil profile, however, each point of the generatrix is displaced by the same amount and in the same direction. During a movement along the directrix, the generatrix, therefore, is moved purely translationally and experiences no rotational movement. A curved generatrix in this case defines a curved but untwisted blade airfoil.

With regard to the envisaged installed position of the turbomachine blade, the blade airfoil has a hub-side end and a casing-side end. In one exemplary embodiment of the disclosure, the angle of inclination in the region of the hub-side end of the blade airfoil, according to amount, is larger than the angle of inclination in the region of the casing-side end.

Consequently, a turbomachine stator blade, which comprises a blade root and a blade tip, wherein the blade root is arranged on the casing-side end of the blade airfoil and the blade tip is arranged on the hub-side end of the blade airfoil, is characterized in that the angle of inclination in the region of the blade tip, according to amount, is larger (7±3 degrees) than in the region of the blade root (0±2 degrees at the end of the region). A turbomachine rotor blade, which comprises a blade root and a blade tip, wherein the blade root is arranged on the hub-side end of the blade airfoil and the blade tip is arranged on the casing-side end of the blade airfoil, is characterized in that the angle of inclination in the region of the blade root, according to amount, is larger (7±3 degrees) than in the region of the blade tip (0±2 degrees at the end of the region). The boundary between the two regions with the appreciably different angles of inclination lies at a relative blade length of 0.7±0.1.

If the blade airfoil is arranged with an angle of inclination, then this means that the pressure face and the suction face of the blade airfoil are oriented either inwards or else outwards in the installed radial direction. In one exemplary embodiment of a turbomachine stator blade, the stacking line, that is to say the trailing edge of the blade, is curved in such a way that in the region of the blade tip, that is on the hub-side end of the blade airfoil, the pressure face of the blade airfoil is oriented inwards in the installed radial direction, that is to say on the hub-side. The pressure face of a stator blade, therefore, is oriented in a manner pointing away from the blade platform in the region of the blade tip, at least on the trailing edge of the blade airfoil. The blade airfoil of a stator blade in the region of the trailing edge is convexly curved towards the pressure face, that is to say the curvature of the bend points towards the pressure face. In one development of the stator blade, the stacking line extends in the root region, that is to say on the casing-side end of the blade airfoil, at least radially, or the airfoil, by the pressure face in the region of the trailing edge, is oriented outwards in the installed radial direction, that is to say on the casing side or towards the blade platform. In one exemplary embodiment of a turbomachine rotor blade, the stacking line is curved in such a way that in the region of the blade root, that is on the hub-side end of the blade airfoil, the suction face of the blade airfoil, in the region of the greatest profile thickness, is oriented inwards in the installed radial direction, that is to say on the hub side. The suction face of a rotor blade, therefore, in the region of the blade root, is oriented towards the blade platform, at least in the region of the greatest profile thickness. The blade airfoil of a rotor blade, in the region of the greatest profile thickness, is convexly curved towards the suction face, that is to say the curvature of the bend points towards the suction face. In one development of the rotor blade, the stacking line extends in the tip region, that is to say on the casing-side end of the blade airfoil, at least radially, or the blade airfoil, by the suction face, is oriented outwards in the installed radial direction, that is to say on the casing side or in a manner pointing away from the blade platform.

A turbomachine blade of the aforementioned type of construction is suitable for example as a blade for a blade cascade which is exposed to axial through-flow. In one exemplary embodiment, it concerns a blade for a steam turbine, especially for a high-pressure or medium-pressure steam turbine.

The described type of construction with turbine blades, which are used in turbines with a hub-tip ratio in the range of between 0.60 and 0.95, displays very advantageous effects.

Turbomachine blades of the previously described type are suitable for use in the stator of a turbomachine, especially of a gas turbine or steam turbine, wherein the stator comprises at least one blade row with stator blades of the type of construction which is described above, or are suitable for use in the rotor of a turbomachine, for example of a gas turbine or steam turbine, wherein the rotor comprises at least one blade row with turbomachine rotor blades of the type which is described above.

A turbomachine, for example a gas turbine or a steam turbine, especially a high-pressure or medium-pressure steam turbine, comprises a rotor and/or a stator of the previously described constructional type. Such a turbomachine in one exemplary embodiment comprises a turbine stage, the stator blades and also rotor blades of which are turbomachine blades of the type which is described above with curved blade airfoils.

For reasons of clarity, the disclosure is illustrated in the following exemplary embodiments based on blades with untwisted blade airfoils. The person skilled in the art will readily be in the position to make a generalization of twisted blades, wherein the stacking line of the blade airfoil is kept unaltered in each case according to definition during the transition from an untwisted blade to a twisted blade.

In FIG. 1, a turbine, for example a high-pressure steam turbine 1, is schematically shown. The turbine which is exemplarily shown is exposed to through-flow of a working fluid from left to right. The turbine comprises a rotor and a stator. The rotor comprises inter alia the shaft 2 and also rotor blades 21. The stator comprises inter alia a casing 3 and stator blades 31. A stage of a turbine comprises in each case a stator blade ring and a rotor blade ring which is arranged downstream of it. Between the stator blades 31 and the shaft 2, and also between the rotor blades 21 and the casing 3, there are gaps through which a leakage flow overflows, unutilized, as a result of which the efficiency of the energy conversion is reduced. The leakage losses also occur with blade rows with shrouds, if even to a lesser extent. The greater the pressure drop across a blade ring in the region of the gap, the greater become these leakage losses. A measure for the distribution of the stage pressure drop to the stator blade ring and to the rotor blade ring of a turbine stage is the degree of reaction. With many customary and otherwise very advantageous blade airfoil geometries, the distribution of the pressure decay to stator blade ring and rotor blade ring over the longitudinal extent of the blade airfoil alters. Thus, the pressure drop across the stator blade ring on the hub side increases, that is to say on the shaft, while at the same time the pressure drop across the rotor blade ring on the hub side, that is to say on the shaft, is less than on the casing side. That is to say, both on the stator blades and on the rotor blades the pressure difference is the greatest in each case when calculated at the gaps. This effect is increased more as the hub-tip ratio becomes smaller. In this case, the hub-tip ratio is defined as the ratio of the diameter of the shaft to the inside diameter of the casing or to the outside diameter of the blade ring.

Figure 2:
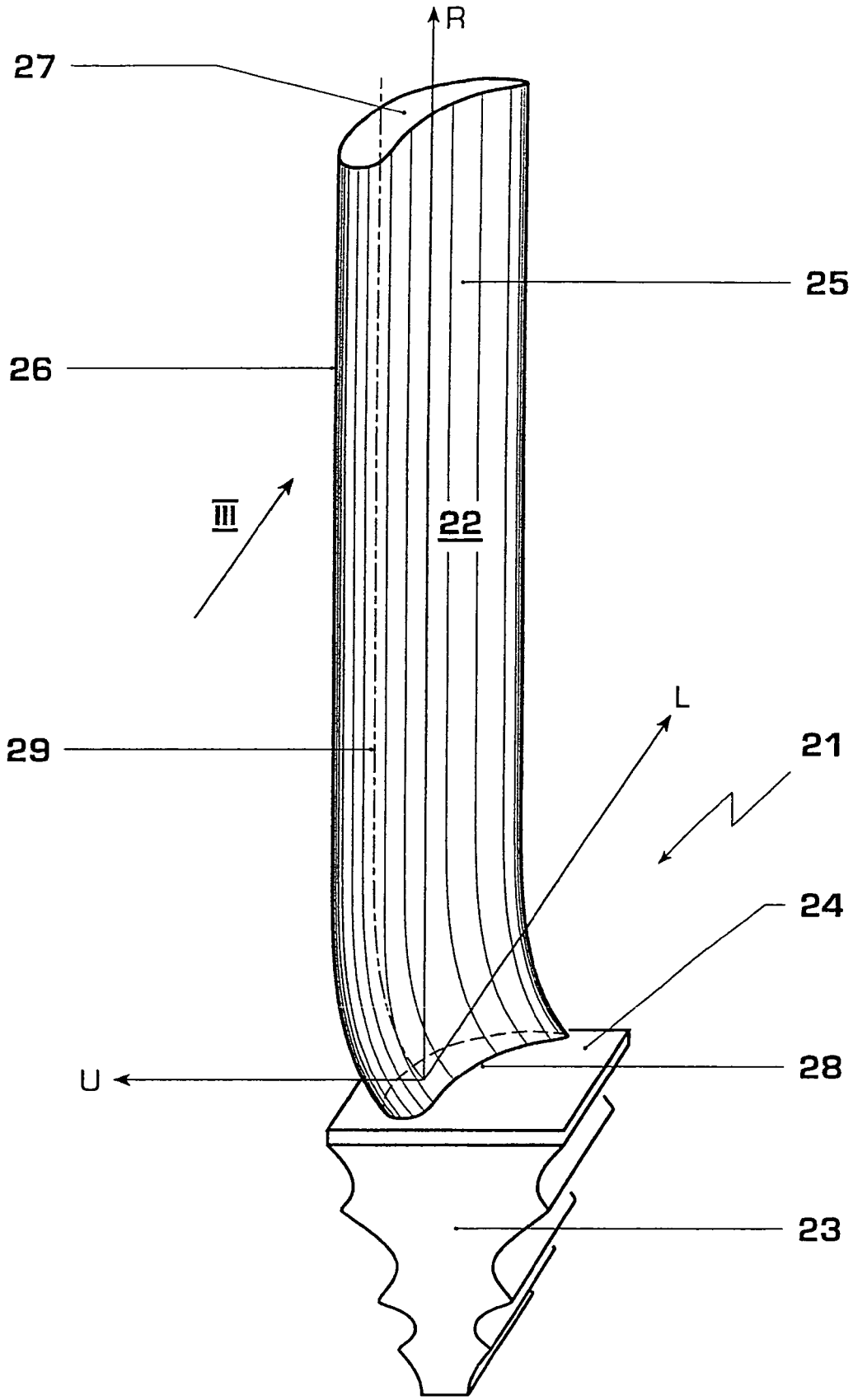
FIG. 2 shows a perspective view of a rotor blade of a turbomachine of the type which is described above.
Figure 3:
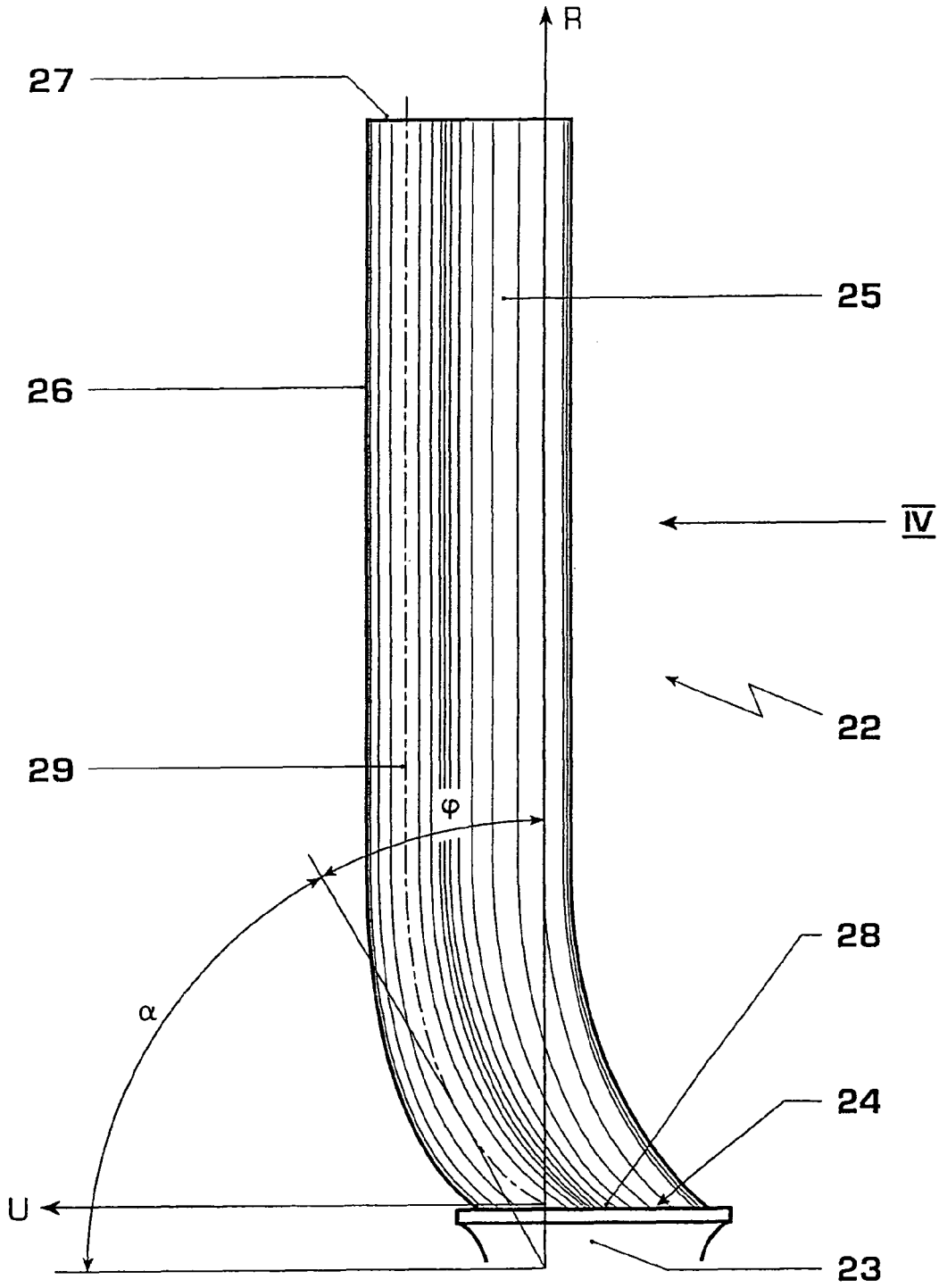
FIGS. 3 and 4 show views of the rotor blade from FIG. 2 from other directions of view.
Figure 4:
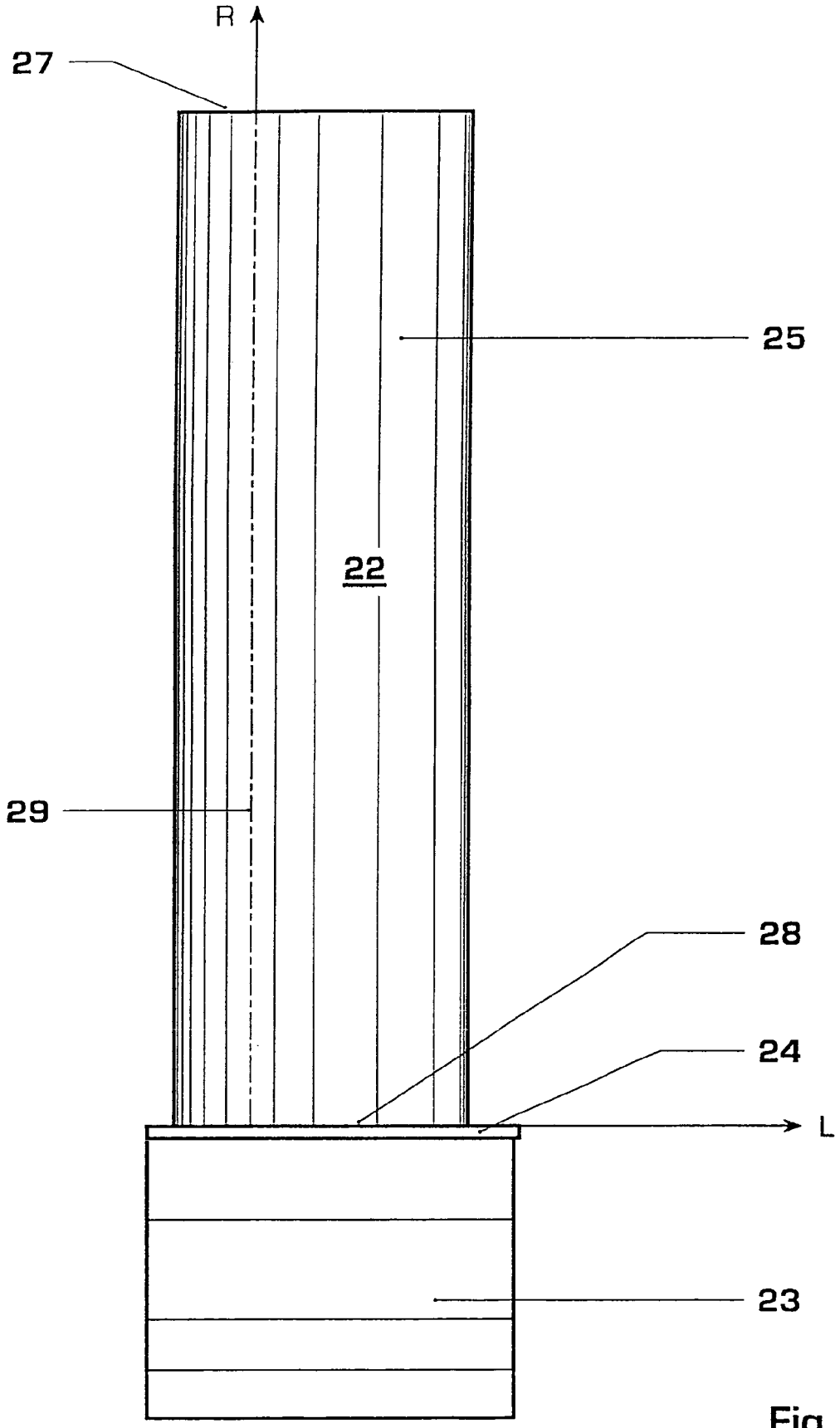

In FIG. 2, a rotor blade of the type of construction which is proposed here is shown. The rotor blade 21 comprises a blade airfoil 22 and a blade root 23. The blade root 23 in this example is provided with a fir tree-form fastening element for fastening the blade in the shaft, and supports a platform 24, upon which the blade airfoil 22 is arranged. The shape of the blade root is not relevant to the disclosure. The geometry of the blade is determined by its application. Therefore, an installed radial direction R, an installed circumferential direction U and an installed axial direction L are defined. The blade airfoil has a pressure face 25, a suction face 26, a tip-side end 27, and also a root-side end 28. The stacking line 29, which is shown by a dash-dot line, extends along a line which interconnects the centers of gravity of the blade profiles which are arranged along the longitudinal extent of the blade airfoil. With a rotor blade of the type which is shown, which is fastened in the shaft of a turbomachine, the root-side end 28 of the blade airfoil is also the hub-side end, while the tip-side end is the casing-side end. In the region of the blade root, the stacking line is inclined in the installed circumferential direction in such a way that the suction face 26 of the blade airfoil is oriented towards the blade platform 24, or, expressed in another way, in such a way that the suction face of the blade airfoil is oriented inwards in the installed radial direction. With the blade which is shown, this indination is oriented so that the stacking line is inclined exclusively in the installed circumferential direction. Furthermore, the blade airfoil in the example is curved in such a way that the stacking line extends purely radially in the region of the blade tip 27. The geometry of the inclination and of the bend of the stacking line, and consequently of the blade airfoil, becomes clearer in FIGS. 3 and 4. In these cases, the blade which is shown in FIG. 2 is shown in FIG. 3 in a direction of view in the direction of the installed axial direction L, and is shown in FIG. 4 in a direction of view in the direction of the installed circumferential direction U. In FIG. 3, the angle of inclination $\phi$ is drawn in, and also an angle $\alpha$ which the stacking line, which is inclined to the blade airfoil suction face, includes with the blade platform or with the tangent of the hub. The angle of inclination $\phi$ is greatest on the root-side end or hub-side end of the blade airfoil (in this case, according to the disclosure, it is in the region of 7±3 degrees), and decreases in the installed radial direction. On the tip-side end of the rotor blade airfoil, this angle becomes smaller, for example to zero as in the present example, or it even changes sign. The angle of inclination $\phi$ in this end region is preferably 0±2 degrees in value. The angle $\alpha$, which the stacking line includes with the blade platform or with the tangent of the hub, is less than 90° on the root-side end and becomes larger towards the tip-side end or casing-side end. As is to be clearly seen in association with FIG. 4, the stacking line is only curved in a plane which is spanned by the installed circumferential direction U and the installed radial direction R. In a plane which is spanned by the installed radial direction R and the installed axial direction L, the stacking line 29 is not curved.

Figure 5:
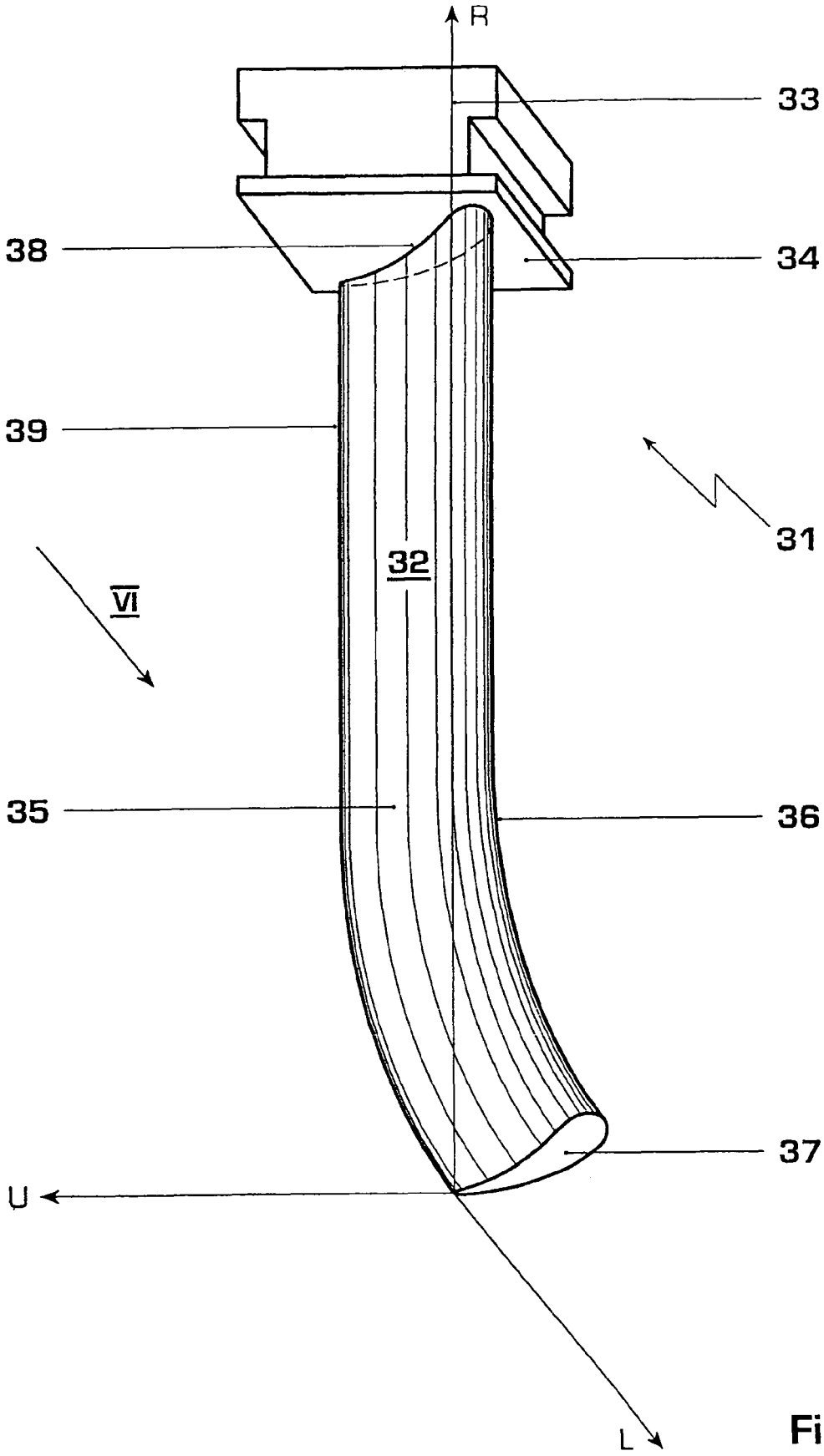
FIG. 5 shows a stator blade for a turbomachine according to the type of construction which is described above.
Figure 6:
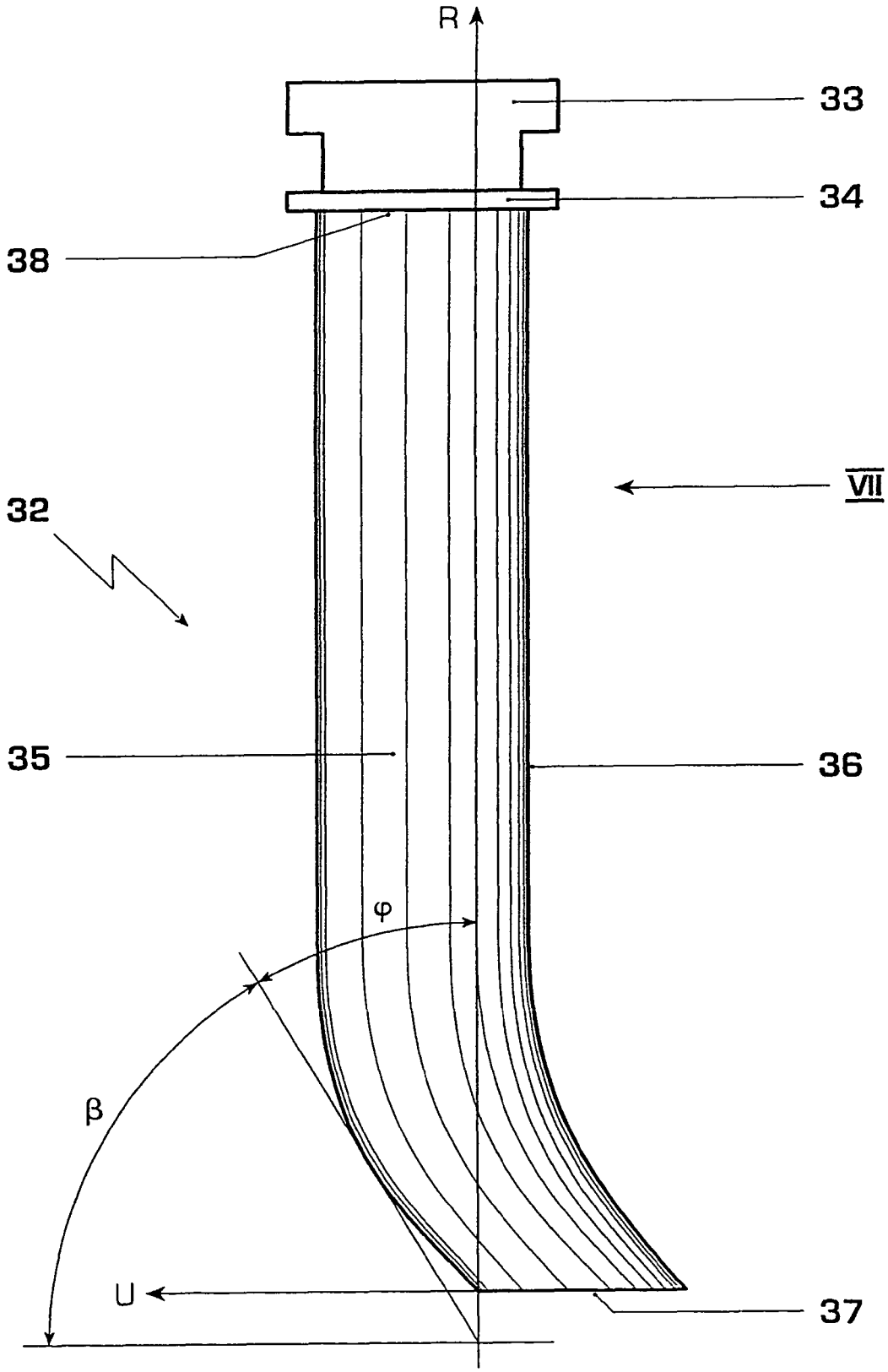
FIGS. 6 and 7 show views of the stator blade from FIG. 5 in other directions of view.
Figure 7:
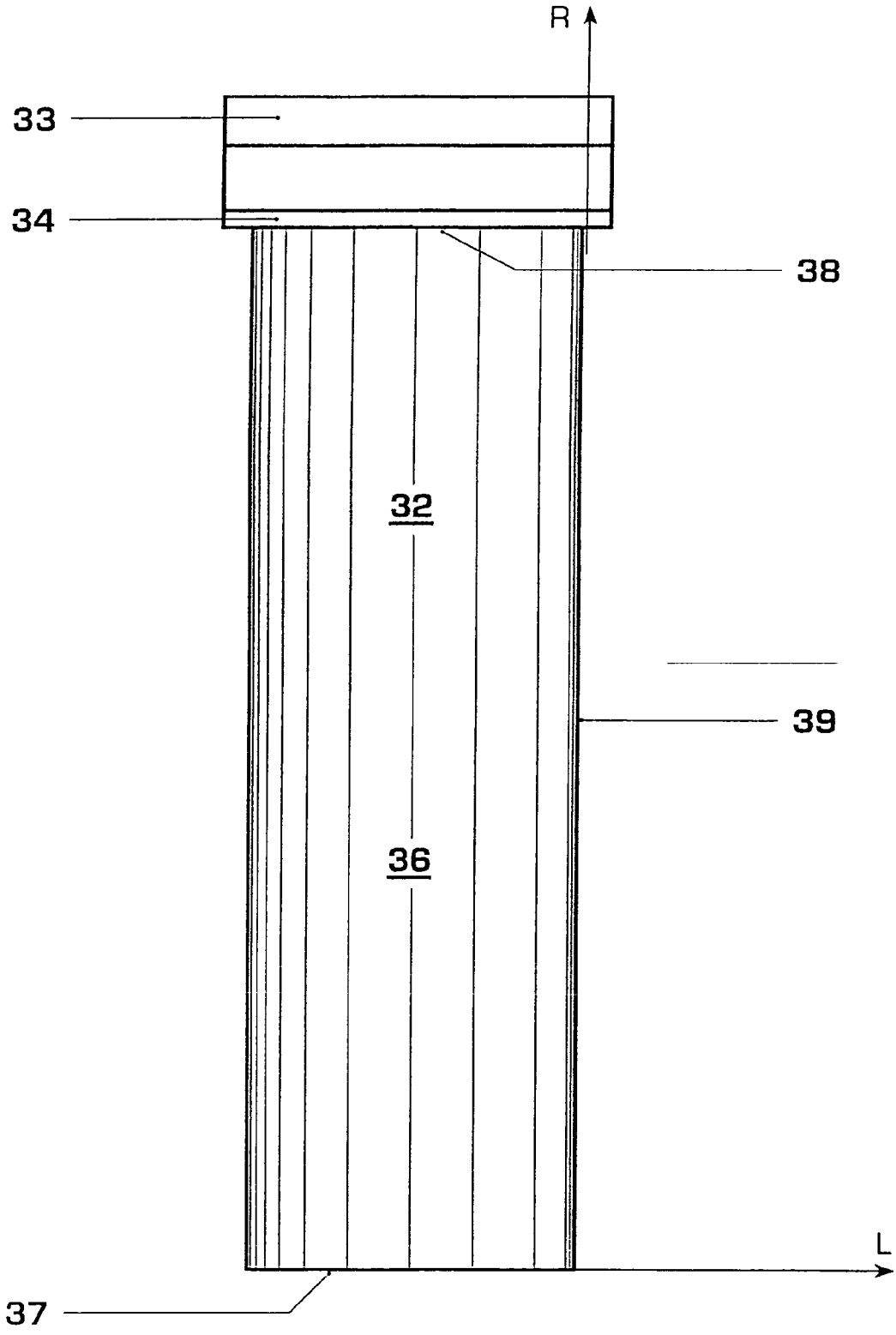

A stator blade of the proposed type is illustrated in FIGS. 5 to 7. The stator blade 31 comprises a blade airfoil 32 which is arranged with the platform 34 on the blade root 33. The blade airfoil has a pressure face 35 and a suction face 36, and also a root-side end 38 and a tip-side end 37. The stacking line 39 lies upon the trailing edge of the blade. With the stator blade which is shown, the tip-side end is also the hub-side end at the same time, which during installation comes to lie on the shaft in a turbomachine. The root-side end is also the casing-side end. In the region of the blade tip 37, the stacking line has an inclination in the installed circumferential direction in such a way that the pressure face of the blade airfoil in the region of the trailing edge is oriented inwards in the installed radial direction, that is to say is oriented towards the hub, while the blade airfoil in the exemplary embodiment which is shown extends radially in the region 38 of the root. The view which is indicated by VI in FIG. 5, is shown in FIG. 6. The local angle of inclination, which is variable along the longitudinal extent of the blade airfoil, in this case is indicated by $\phi$. The stacking line is oriented towards the pressure face, and with the tangent of the hub includes an angle β in the installed state. This angle is less than 90° on the hub-side end of the blade airfoil, and becomes larger towards the casing-side end or root-side end. In association with the view which is shown in FIG. 7, in the direction of view which is represented by VII, it becomes clear that the bend again lies two-dimensionally in the plane which is spanned by the installed circumferential direction U and by the installed radial direction R.

It is to be noted that in the previously shown exemplary embodiments, the angle of inclination ϕ is generally shown excessively large, this in the sense of an improved representation. In one exemplary embodiment of the described blade, the angle of inclination on the hub-side end of the blade airfoil typically shifts in the range of 7±3 degrees, preferably in the range of between 6 and 8 degrees, in order to become smaller in the region of the casing, and in embodiment forms to return to zero, or even to a negative value, wherein ϕ=0±2 degrees, and wherein according to definition, see, for example, the reference to Traupel which is quoted above, an angle of inclination, by which the blade airfoil is inclined from the hub in the direction of rotation, that is to say inclined towards the pressure face in the case of stator blades and towards the suction face in the case of rotor blades, is counted as a positive angle.

In FIG. 8, a schematized cross section of a turbomachine with blades of the type which is described above is shown, and also exemplary variations of the angle of inclination ϕ over the length of the blade airfoils. A shaft 2 of a turbomachine, the casing 3, and also the blade airfoils of a rotor blade 21 and of a stator blade 31 in each case, are shown in cross section. The direction of rotation of the rotor is indicated by ω, and the angle of inclination of a blade airfoil is indicated by ϕ. s indicates a radial coordinate of the height $s_O$ of the passage which is formed between the casing and the shaft. Exemplary variations of the angle of inclination over the height of the passage or over the longitudinal extent of a blade airfoil are indicated in the diagram.

According to the disclosure, the angle of inclination ϕ, up to a relative blade length of 0.7±0.1 (corresponds approximately to the ratio $s/s_O$ of 0.7±0.1 in the diagram of FIG. 8) is 7±3 degrees, is about 8 degrees according to the exemplary embodiment in FIG. 8, while with a relative blade length lying above it, the angle of inclination ϕ is smaller, until with a relative blade length of 1 the angle of inclination is ϕ=0±2 degrees. The curve which is shown in the lower section of FIG. 8 is consequently clearly divided into two regions.

It will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

LIST OF DESIGNATIONS

1 Turbomachine, steam turbine
2 Shaft
3 Casing
21 Rotor blade
22 Rotor blade airfoil
23 Rotor blade root
24 Blade platform
25 Pressure face
26 Suction face
27 Tip-side end or casing-side end of the blade airfoil
28 Root-side end or hub-side end of the blade airfoil
29 Stacking line of a rotor blade airfoil
31 Stator blade
32 Blade airfoil
33 Blade root
34 Blade platform
35 Pressure face
36 Suction face
37 Tip-side end or hub-side end of the blade airfoil
38 Root-side end or casing-side end of the blade airfoil
39 Stacking line of a stator blade airfoil
L Installed axial direction
R Installed radial direction
U Installed circumferential direction
s Radial coordinate
$s_O$ Blade spread
ϕ Angle of inclination
α Angle between stacking line, which is inclined on the suction face side, and tangent of the hub
β Angle between stacking line, which is inclined on the pressure face side, and tangent of the hub
ω Direction of rotation

What is claimed is:

1. A turbomachine stator blade, comprising a blade airfoil, which extends with a longitudinal extent of the blade airfoil from a blade root to a blade tip, wherein the turbomachine stator blade has an installed radial direction, an installed circumferential direction and also an installed axial direction, and also a stacking line, wherein an angle of inclination is defined as the angle which a projection of the stacking line has with the installed radial direction, in a plane which is spanned by the installed circumferential direction and the installed radial direction, and wherein the angle of inclination (ϕ) varies along the longitudinal extent of the blade airfoil, wherein in the region of the blade tip the pressure face of the blade airfoil is oriented inwards in the installed radial direction, and the stacking line is convexly curved towards the pressure face of the blade airfoil, and wherein the blade airfoil extends at least radially in the root region, or by the pressure face is oriented outwards in the installed radial direction.

2. The turbomachine stator blade as claimed in claim 1, wherein the variation of the angle of inclination (ϕ) along the longitudinal extent of the blade airfoil occurs in two different regions, wherein the one region extends to a relative blade length of 0.7±0.1, and has an angle of inclination (ϕ) in the region of 7±3 degrees, and the second region which is adjacent to it extends to a relative blade length of 1, and at the end of this second region the angle of inclination (ϕ) is just 0±2 degrees.

3. The turbomachine stator blade as claimed in claim 2, wherein the stacking line lies upon the trailing edge of the blade.

4. The turbomachine stator blade as claimed in claim 1, wherein the stacking line lies upon the trailing edge of the blade.

5. The turbomachine stator blade as claimed in claim 4, wherein the stacking line is two-dimensionally curved in a plane which is spanned by the installed circumferential direction and the installed radial direction.

6. The turbomachine stator blade as claimed in claim 1, wherein the stacking line is two-dimensionally curved in a plane which is spanned by the installed circumferential direction and the installed radial direction.

7. The turbomachine stator blade as claimed in claim 6, wherein the blade airfoil has a hub-side end and a casing-side end, wherein the angle of inclination in the region of the hub-side end is larger than the angle of inclination in the region of the casing-side end.

8. The turbomachine stator blade as claimed in claim 1, wherein the blade airfoil has a hub-side end and a casing-side end, wherein the angle of inclination in the region of the hub-side end is larger than the angle of inclination in the region of the casing-side end.

9. The turbomachine stator blade as claimed in claim 8, comprising a blade root and a blade tip, wherein in the region of the blade tip the pressure face of the blade airfoil is oriented inwards in the installed radial direction, and the stacking line is convexly curved towards the pressure face.

10. The turbomachine stator blade as claimed in claim 1, wherein the blade airfoil is an untwisted blade airfoil which is curved in such a way that an angle, which the pressure face of the blade airfoil includes with a platform of the blade root, varies in the longitudinal extent of the airfoil.

11. The turbomachine stator blade as claimed in claim 10, wherein it is a blade for a blade cascade which is exposed to axial through-flow.

12. The turbomachine stator blade as claimed in claim 1, wherein it is a blade for a blade cascade which is exposed to axial through-flow.

13. The turbomachine stator blade as claimed in claim 12, as a steam turbine blade.

14. The turbomachine stator blade as claimed in claim 1, as a steam turbine blade.

15. A stator of a turbomachine, comprising at least one blade row with turbomachine stator blades as claimed in claim 1.

16. A turbomachine comprising a stator as claimed in claim 15, and at least one blade row with turbomachine rotor blades.

17. A turbomachine, comprising a stator as claimed in claim 15.

18. A turbomachine comprising at least one turbine stage, the stator blades of which are stator blades as claimed in claim 1, and rotor blades, a rotor blade comprising a blade root and a blade tip, wherein in the region of the blade root the suction face of the blade airfoil is oriented inwards in the installed radial direction, and a stacking line is convexly curved towards the suction face of the blade airfoil.

19. A stator of a turbomachine, comprising at least one blade row with turbomachine stator blades as claimed in claim 1.

20. A turbomachine rotor blade, comprising a blade airfoil, which extends with a longitudinal extent of the blade airfoil from a blade root to a blade tip, wherein the turbomachine rotor blade has an installed radial direction, an installed circumferential direction and also an installed axial direction, and also a stacking line, wherein an angle of inclination is defined as the angle which a projection of the stacking line has with the installed radial direction, in a plane which is spanned by the installed circumferential direction and the installed radial direction, and wherein the angle of inclination ($\phi$) varies along the longitudinal extent of the blade airfoil, wherein in the region of the blade root the suction face of the blade airfoil is oriented inwards in the installed radial direction, and the stacking line is convexly curved towards the suction face of the blade airfoil, and wherein the blade airfoil extends at least radially in the tip region, or by the suction face is oriented outwards in the installed radial direction.

21. A rotor of a turbomachine, comprising at least one blade row with turbomachine rotor blades as claimed in claim 20.

22. A steam turbine comprising at least one blade row with turbomachine stator blades, and a rotor as claimed in claim 21.

23. A turbomachine, comprising a rotor as claimed in claim 21.

24. The turbomachine rotor blade as claimed in claim 20, wherein the blade airfoil is an untwisted blade airfoil which is curved in such a way that an angle, which the pressure face of the blade airfoil includes with a platform of the blade root, varies in the longitudinal extent of the airfoil.

25. A rotor of a turbomachine, comprising at least one blade row with turbomachine rotor blades as claimed in claim 20.

26. A steam turbine comprising at least one turbine stage having rotor blades as claimed in claim 20, and stator blades, each stator blade comprising a blade root and a blade tip, wherein in the region of the blade tip the pressure face of the blade airfoil is oriented inwards in the installed radial direction, and a stacking line is convexly curved towards the pressure face.

27. The turbomachine rotor blade as claimed in claim 20, wherein the stacking line is a line which interconnects the centroids of all profile cross sections which are arranged in the longitudinal extent of the blade airfoil.

* * * * *